US009508278B2

(12) United States Patent
Jain et al.

(10) Patent No.: US 9,508,278 B2
(45) Date of Patent: Nov. 29, 2016

(54) PRESENT CONTENTS ON PERSISTENT DISPLAY

(71) Applicant: Intel Corporation, Santa Clara, CA (US)

(72) Inventors: Himanshu Jain, Beaverton, OR (US); Abhay A. Dharmadhikari, Portland, OR (US); Benjamin Thor Oien, Wilsonville, OR (US); Brandon Gavino, Beaverton, OR (US); Sameer Abhinkar, Portland, OR (US); Dwayne Canfield, Portland, OR (US); Naveen Nanja, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 263 days.

(21) Appl. No.: 14/187,068

(22) Filed: Feb. 21, 2014

(65) Prior Publication Data

US 2015/0243236 A1 Aug. 27, 2015

(51) Int. Cl.
*G09G 5/00* (2006.01)
*G09G 3/20* (2006.01)

(52) U.S. Cl.
CPC ..... *G09G 3/20* (2013.01); *G09G 3/2044* (2013.01); *G09G 2320/0673* (2013.01); *G09G 2330/027* (2013.01); *G09G 2360/16* (2013.01)

(58) Field of Classification Search
CPC ..... G09G 3/20
USPC ..... 345/211
See application file for complete search history.

(56) References Cited

U.S. PATENT DOCUMENTS

2010/0033468 A1* 2/2010 Sugamata ..... G09G 3/344 345/211
2010/0033491 A1* 2/2010 Sugamata ..... G09G 3/344 345/530

* cited by examiner

*Primary Examiner* — Jason Olson
(74) *Attorney, Agent, or Firm* — Schwegman Lundberg & Woessner, P.A.

(57) ABSTRACT

Various systems and methods for presenting contents on a persistent display are described herein. A system for controlling an electronic display comprises a persistent display; a trigger module to detect a triggering event; a configuration module to access a dead screen configuration in response to the triggering event, the dead screen configuration specifying content to display on the persistent display of the system after the system is powered down; and an output module to write the specified content to the persistent display as an image.

25 Claims, 5 Drawing Sheets

PRESENT CONTENTS ON PERSISTENT DISPLAY

TECHNICAL FIELD

Embodiments described herein generally relate to electronic displays and in particular, to presenting contents on a persistent display.

BACKGROUND

A display device is used to present information in a visual form. In recent years low-power display devices have been developed. Bi-stable liquid crystal displays (LCD), electronic ink, and related technologies may be used to hold a static image without using electricity.

BRIEF DESCRIPTION OF THE DRAWINGS

In the drawings, which are not necessarily drawn to scale, like numerals may describe similar components in different views. Like numerals having different letter suffixes may represent different instances of similar components. Some embodiments are illustrated by way of example, and not limitation, in the figures of the accompanying drawings in which.

DETAILED DESCRIPTION

A persistent display is a display device that may present information without using electricity. Examples of a persistent display include, but are not limited to a bi-stable LCD or an electronic paper (e.g., electrophoretic, electrowetting, electrofluidic, etc.) device. Persistent displays continue to present an image, text, or other graphics even after being powered off. In the case of a bi-stable LCD, the crystals may exist in one of two stable orientations (e.g., "black" and "white") and power is only used to change the image. In the case of electronic paper, particles may be used to block the reflection of an underlying substrate or colored capsules may be suspended in a liquid and electrically moved block or reflect light. The state of the crystals or particles is stable and does not change until an electric charge is applied.

Persistent displays may be used in a variety of forms and for a variety of applications. For example, persistent displays may be used in electronic readers (e-readers), mobile phone displays, retail applications, digital signage, and the like. A persistent display may be used alone, such as in an e-reader form. Alternatively, a persistent display may be used as a status display in conjunction with a primary display. For example, a laptop computer may have a persistent display on the outside of the lid to display the time and have a primary display (e.g., LCD) on the inside of the lid for conventional usage. As another example, an e-reader may include a primary electronic paper display for reading and another LCD display for browsing book titles.

While persistent displays may use less power, they still require some power to update the contents of the display. Over time, as a persistent display is refreshed, the persistent display (and corresponding system components) will eventually drain a battery. When power is lost due to a low-battery situation or when a device is powered off (e.g., shutdown), it would be advantageous to provide user-configured information on the persistent display so that the user is able to continue to refer to the information even after the electronic device is powered off.

Currently there is no method of automatically prompting a user for information to be displayed on a device being powered down. For devices with persistent display technology, the information last presented to the user remains visible after the device loses power. This document describes a system and method to allow the user to select and customize content to be displayed on the persistent display at shutdown or loss of power.

Figure 1:
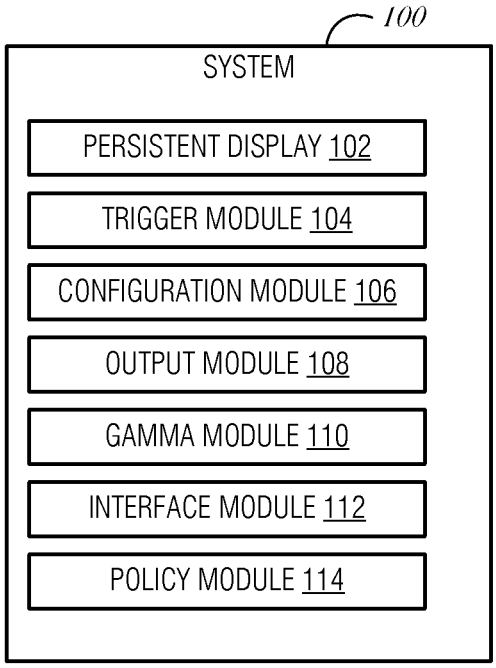
FIG. 1 is a schematic drawing illustrating a system to present contents on a persistent display, according to an embodiment.

FIG. 1 is a schematic drawing illustrating a system 100 to present contents on a persistent display 102, according to an embodiment. As discussed above, the persistent display 102 is able to present content without continuous power. In various embodiments, the persistent display 102 may be a bi-stable LCD display or an electronic paper display.

The system 100 may be any type of electronic or computing device, including but not limited to a smartphone, cellular telephone, mobile phone, laptop computer, tablet computer, in-vehicle infotainment system, digital billboard, or other networked device.

In operation, a user may configure a "dead screen" display. The dead screen display includes contents to be displayed when the power is off. The user may configure the dead screen at various times, such as during a shutdown procedure, after a low-battery warning, during initial configuration of the system 100, or during the regular course of operation of the system 100. Various types of content may be selected by the user including, but not limited to a calendar or calendar event data, navigation data, lost phone information, a shopping list, or contact information. The dead screen selection and customization is such that a user may easily display task-relevant information prior to the loss of power.

In an embodiment, a prompt to select the dead screen contents is presented to the user when shutdown is imminent (e.g., in response to a shutdown command or after a low-battery condition). This enables the user to set task-relevant information to be displayed. If the user dismisses the prompt, default information may be used, such as a previously-displayed screen or other default dead screen.

During a manual shutdown, a prompt may be displayed and interrupt the shutdown sequence. The prompt may be displayed until the user interacts and selects content or manually dismisses the prompt. The dead screen contents may be written to the persistent display 102 after the selection is made.

In a low-battery situation, the prompt may be provided at a threshold percentage (e.g., 5% battery remaining). The prompt may be displayed and interrupt the user's current task. Right before the system 100 runs out of operational power, the system 100 may write the dead screen contents to the persistent display 102. Alternatively, if the user shuts down the system 100 after being notified of the low-battery situation, the system 100 may write the dead screen contents to the persistent display 102 at that time.

Various types of content may be selected by the user or the user may provide customized content (e.g., text, graphics, icons, images) to display on the persistent display 102. It is understood that the following sections are examples of different types of content and that any type of content may be presented on the persistent display 102.

Calendar: A list of calendar events, reminders, appointments, or other calendar data may presented to the user. The user may select one or more calendar items for display. The selected calendar data is then used as the dead screen.

Navigation: The user may be prompted for a destination (address, point of interest, etc.) and optionally a start address. If no start address is provided, the user's current location may be used. The persistent display 102 may be used to present a route, map, or other navigation data. In the case where multiple routes to the destination are available, the user may select a route for display. In this manner, the user may verify the correctness of the navigation instructions.

Contacts: The user may be presented with a list of contacts and allowed to select a number of contacts to display. The contacts may be obtained from an address book stored at the system 100 or obtained from a networked source (e.g., an online address book). The user may be prompted to choose which fields to use for each contact (address, mobile number, etc.). Once the user confirms this information, the dead screen contents are set.

Lost Phone Information: The user may select personal information from the user's own contact info to be displayed.

Custom Message: Instead of being prompted for a certain type of information, the user may provide, select, or configure contents to present as the dead screen. For example, this option allows the user to store and display a quick reminder or note to themselves post device shutdown, such as a shopping list or a task list. In an embodiment, the user is presented a text input control to write a message for display.

It is understood that one or more types of information may be configured and displayed as a dead screen. For example, a user may configure the dead screen to display contact information and a navigation route to the contact's office. It also understood that various formats of content may be displayed, such as text, images, or graphics.

Figure 2:
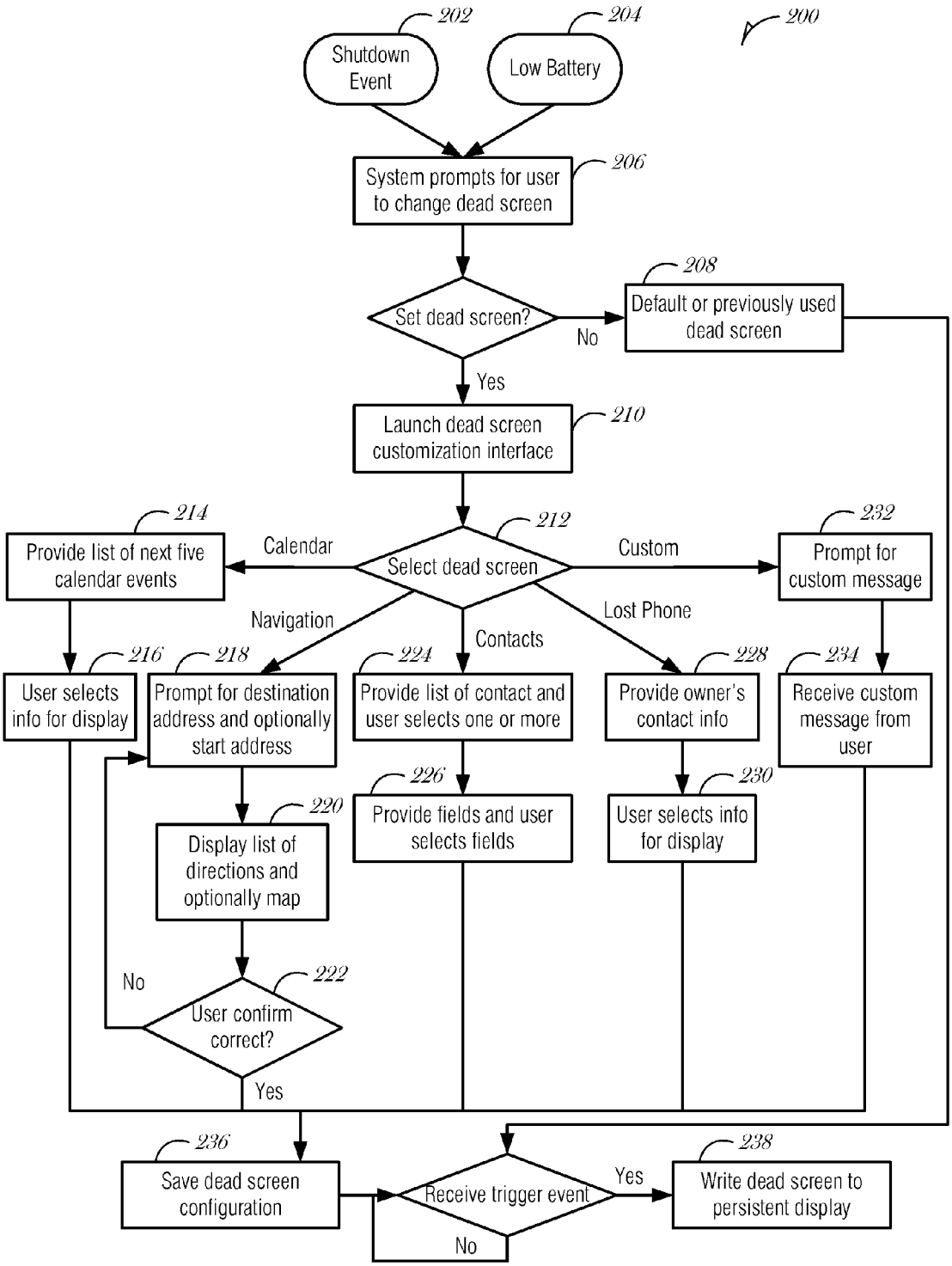
FIG. 2 is a flowchart illustrating a process to configure the contents of a persistent display, according to an embodiment.

FIG. 2 is a flowchart illustrating a process 200 to configure the contents of a persistent display, according to an embodiment. A shutdown event (block 202) or a low battery event (block 204) may initiate the process 200. In response to the initial event, the system may prompt the user for to change the dead screen (block 206). If the user opts out of changing the dead screen, then at block 208 the default dead screen is used (e.g., a default picture, message, or content) or a previously-used dead screen is used. If the user opts to configure the dead screen, then at block 210, a dead screen customization interface is launched. The dead screen customization interface may be one or more dialog boxes, property sheets, or other user interface constructs that allow the user to configure various aspects or content of the dead screen.

At decision block 212, the user is able to choose among various choices. In FIG. 2, the user may choose to configure the dead screen with calendar content, navigation content, contacts content, lost phone content, or custom contact.

If the user chooses to use calendar content, then at block 214, the dead screen configuration user interface may provide a list of the next five calendar events. The user may choose what content to display at block 216. The content may include one or more of the calendar events or portions of one or more of the calendar events, such as the description, time, date, priority, attendees, notes, or other information regarding a calendar event.

If the user chooses to use navigation content, then at block 218, the dead screen configuration user interface may prompt for a destination address and optionally for a starting address. At block 220, the dead screen configuration user interface may display a list of directions and optionally a map of the route. If the user does not confirm that the directions are accurate, a new destination or starting address is prompted for and received (block 222).

If the user chooses to use contacts content, then at block 224, the dead screen configuration user interface may provide a list of one or more contacts and the user may select one or more from the list. After selecting the contacts, the user may select one or more fields to display, such as the name, address, phone number, email address, or the like (block 226).

If the user chooses to use lost phone content, then at block 228, the dead screen configuration user interface may prompt for the owner's contact information. By displaying the owner's contact information and optionally a message, if the device is lost, a person who finds it will know who to contact in order to return it. At block 230, the user is able to select which information to display.

If the user chooses to use custom content, then at block 232, the dead screen configuration user interface may prompt for the content using a text field or other input field. The custom message is received at block 234.

After the user inputs the information, the dead screen configuration is saved (block 236). Upon receiving a trigger event, such as a shutdown or low-battery state, the dead screen is written to the persistent display (block 238).

Returning to FIG. 1, in the case of images, such as photographs, image processing may be used to convert the original image format to one that is presentable on a persistent display 102. In an embodiment, the system 100 includes a high-resolution color display in addition to the persistent display 102. The persistent display 102 may be lower resolution, such as 4-bit (e.g., 16 level grey scale) or 8-bit (e.g., 256 level grey scale). Image processing may be used to optimize the image for the lower-resolution of the persistent display 102.

An image captured from a high resolution camera or a downloaded high pixel density image has unequal distribution of full color ARGB space. It is not trivial to determine when to apply image processing or which image processing techniques to apply. What is needed is an efficient process to determine when to apply image processing to a high-resolution image for display on a lower-resolution display.

In an embodiment, two metrics are calculated. The first metric correlates to a measure of unused colors in an image. That in turn determines when to apply a dithering algorithm. The second metric correlates to the ratio between the number of dark pixels and light pixels in an image. The second metric may be used to determine what gamma correction value is needed to both improve contrast and maximize usage of color space. It is important to note that both metrics use the same calculation in the $O(n^2)$ loop and require very few processor cycles.

The unused color metric is an integer based on a threshold compare with a bucket tally where each bucket represents a 256-level greyscale color. If the metric is high (e.g., >200), the image uses only a small proportion of the ARGB space. This indicates that the image is either black and white or restricted to specific colors such as vector graphics. In that case, dithering is not applied. If the unused color metric shows more than minimal use of the ARGB space (e.g., <200), the image will have banding in gradients along with other artifacts when reduced to a lower resolution (e.g., 16 level grey scale). Dithering is applied to mitigate these artifacts.

Figure 3:
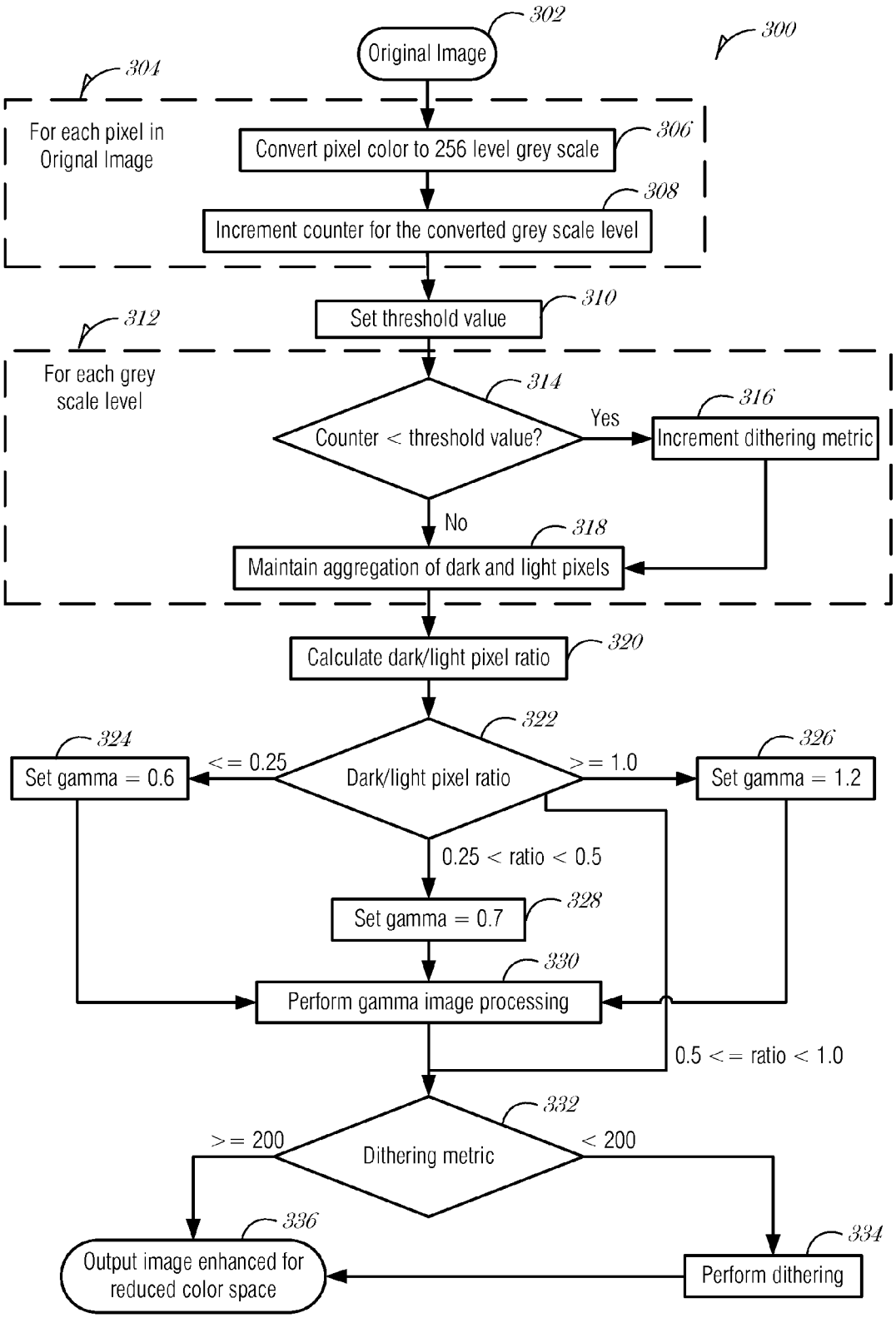
FIG. 3 is a flowchart illustrating a process to determine image processing to be applied to contents displayed on a persistent display, according to an embodiment.

The second metric, the dark to light pixel metric, is based on the ratio of the number of dark pixels to light pixels. A value less than 1 means that there are more light pixels than dark pixels and that the image should be darkened to more effectively use the available color space. This case, a gamma correction value less than 1.0 should be used. In contrast, when the second metric has a value of greater than 1, then there are more dark pixels than light and a gamma correction value greater than 1.0 should be used. In an embodiment, the second metric to gamma is as follows: metric<0.25->gamma=0.6; 0.25<metric<0.50->gamma=0.7; and metric>1->gamma=1.2. This is illustrated in FIG. 3, described below. It is understood that other mappings may be used to map the second metric (dark to light pixel ratio) to a gamma setting.

In some cases where there are two displays, such as a conventional LCD high-resolution display and a lower-resolution persistent display, it may be advantageous to control the content presented on each display. In some embodiments, this control may be provided by way of policies created by an administrative user. A user may define a policy for displaying content on a persistent display based on one or more factors. Several form factors of devices with multiple displays are considered in this disclosure. Form factors include devices with a high-resolution display on one side of a device and a persistent display on the other side of the device (e.g., a mobile phone with a color LCD on one side and a persistent electronic paper display on the other side). In this form factor, the persistent display may be presented while the phone is face down and be used to provide status information, such as the time or a current incoming caller identification. Other form factors are considered, such as having two displays on one side of a tablet device, or having a larger convention screen on a laptop and a smaller persistent display on the backside of the lid (e.g., front facing) or near the keyboard. Additionally, form factor that have more than one high-resolution display or more than one persistent display are also considered to be within the scope of this disclosure. For example, a tablet device may include a high-resolution screen and a persistent display on one side of the device and another persistent display on the other side of the device.

By using policies provided by the user, context may be taken into account for the content presented on a persistent display. In operation, a user may select one or more events to monitor. The user may also select or configure a triggering condition or other parameters related to the events. The user may also assign one or more actions to execute when the events occur with the appropriate triggering conditions. The combination of the event to monitor, the trigger, the parameters, and the action defines a policy. The policy may be always active or active based on configuration (e.g., active after the device has been locked).

The events may be selectable or configurable by an administrative user or a device manufacturer, for example. The events may include receiving a text message, receiving a phone call, missing a phone call, receiving an email, the time or date, a battery charge level, or the like.

The trigger conditions may include various states, such as who a text message or phone call is from, the device orientation at the time of the event, other sensor state at the time of the event, the time or date of the event, a percentage of battery charge, or the like.

Actions may include displaying a certain message on the persistent display 102, modifying the input behavior of the persistent display 102 (e.g., disabling or enabling touch input), powering on or off the high-resolution display or the persistent display 102, or the like.

The following are a few examples of policies that a user may configure. It is understood that many other policies are possible and that the following section is not restrictive.

In one example, a user may configure a policy such that when a short messaging service (SMS) text is received and the battery charge is under 25% remaining, the persistent display 102 is updated to display SMS information (e.g., the SMS sender, the time of the message, the contents of the message, etc.) and the high-resolution display is not powered on to notify the user of the SMS message. In this example, there may have been a default configuration to display a notification on the high-resolution display of the incoming SMS message.

In another example, a user may configure a policy such that when a call is received and the high-resolution screen is powered off (e.g., in a sleep state), and the persistent display 102 is facing the user, then the persistent display 102 is updated with the caller's information. Determining whether the persistent display 102 is facing the user may be performed by checking the system's orientation, by using a camera on the same face as the persistent display 102, or other mechanisms. In addition, the policy may indicate that the high-resolution display is not to be powered on and that input from the persistent display 102 may be used to answer or ignore the call (e.g., via a touch screen persistent display).

In another example, a policy may be used to ignore or disable a persistent display 102 from receiving input when the high-resolution display is powered on and facing the user. This may be used to avoid false or mistaken input while the user is handling a device.

In general, FIG. 1 illustrates a system 100 for controlling an electronic display, the system comprising a persistent display 102, a trigger module 104, a configuration module 106, and an output module 108.

The trigger module 104 may be configured to detect a triggering event. In an embodiment, the triggering event comprises a low battery condition of the system. In an embodiment, the triggering event comprises a shutdown command.

The configuration module 106 may be configured to access a dead screen configuration in response to the triggering event, the dead screen configuration specifying content to display on the persistent display of the system after the system is powered down.

The output module 108 may be configured to write the specified content to the persistent display as an image. In an embodiment, the content includes at least one of a calendar event, a navigation route, a contact, or lost phone information.

In an embodiment, to write the specified content to the persistent display, the output module 108 conditionally performs dithering on the image depending on a gamma metric of the image. In an embodiment, the gamma metric is calculated by analyzing pixels in the image to calculate a ratio of dark pixels to light pixels, and wherein the dithering is performed when the gamma metric is less than a threshold value of the ratio. In an embodiment, the threshold value is two-hundred.

In a further embodiment, the system includes a gamma module 110 to select a gamma value based on the ratio of dark pixels to light pixels and apply the gamma value to the image. In an embodiment, to select the gamma value, the gamma module 110 sets the gamma value to 0.6 when the ratio of dark pixels to light pixels is less than or equal to 0.25. In an embodiment, to select the gamma value, the gamma module 110 sets the gamma value to 0.7 when the ratio of dark pixels to light pixels is between 0.25 and 0.5. In an embodiment, to select the gamma value, the gamma module 110 sets the gamma value to 1.2 when the ratio of dark pixels to light pixels is greater than or equal to 1.

In a further embodiment, the system 100 includes an interface module 112 configured to prompt a user of the system for a selection of content to be displayed on the persistent display.

In a further embodiment, the system 100 includes a policy module 114 to receive a policy definition from a user, the policy definition including the triggering event and a resulting action. In an embodiment, the resulting action configures the specified content. In an embodiment, the system 100 comprises a primary display and the persistent display 102, and the triggering event of the policy definition includes a state of the primary display and a state of the persistent display 102.

FIG. 3 is a flowchart illustrating a process 300 to determine image processing to be applied to contents displayed on a persistent display, according to an embodiment. At block 302, an image is accessed. The image may have been presented on a high-resolution color display. At section 304, each pixel in the image is processed. For each pixel, the pixel color is converted to a grey scale level (block 306). In the example illustrated in FIG. 3, the pixels are converted to a 256 level grey scale. It is understood that the pixels may be converted to some other color resolution, such as 16 level grey scale. Counters are maintained for each grey scale level (e.g., 256 counters) in order to keep track of the number of converted pixels at each grey scale color (block 308).

At block 310, a threshold value is set. The threshold is used to filter color counters with a low count (e.g., unused or poorly represented colors). In an embodiment, the threshold value is set to the number of pixels in the image divided by the number of grey scale colors (e.g., 256) and then divided by two.

At section 312, each grey scale color is processed. For each grey scale color, it is determined whether the number of pixels at that grey scale color is less than the threshold value (decision block 314). If so, then a dithering metric is incremented (block 316). The dithering metric is used later to determine whether to dither the output image. The dithering metric may be initialized to a value, such as zero. At block 318, the number of dark and light pixels are counted and stored. Dark and light pixels may be determined based on a color threshold. In an embodiment, the grey scale colors are indexed from 0 to 255 and dark colors are considered those colors that have an index less than 85, while light colors are considered those colors that have an index greater than 170. Other threshold values may be used to bucket dark or light colors.

At block 320, a ratio of dark to light grey scale colors is calculated. A higher ratio (e.g., over 1) means that the number of dark pixels is greater than the number of light pixels and that the image should be lightened before being output. Conversely, a lower ratio (e.g., under 0.25) means that the number of light pixels is greater than the number of dark pixels and that the image should be darkened before being output.

At decision block 322, the dark/light pixel ratio is identified and a gamma value is set based on the value of the dark/light pixel ratio (blocks 324, 326, 328, and 330). If the dark/light pixel ratio falls in a certain range, no gamma correction is needed (e.g., between 0.5 and 1.0 in the example illustrated in FIG. 3).

If the dithering metric is high, then it means that the number of unused or poorly represented colors is also high (from block 314 from above). As a result, the image has a large variety of colors. Conversely, if the dithering metric is low, then it means that the number of unused or poorly represented colors is low. In this case, the image is may be dominated by fewer colors. At decision block 332, the dithering metric is identified. If the dithering metric is under a threshold value (e.g., two hundred in the example illustrated in FIG. 3), then dithering is performed (block 334). Dithering acts to create the illusion of color depth in images with a limited color palette. Thus, use of dithering on an image with a lower dithering metric may reduce banding or other visual side-effects from reducing the color palette.

After gamma correction and dithering are applied (if applicable), an image enhanced for a reduced color space is output (block 336).

Figure 4:
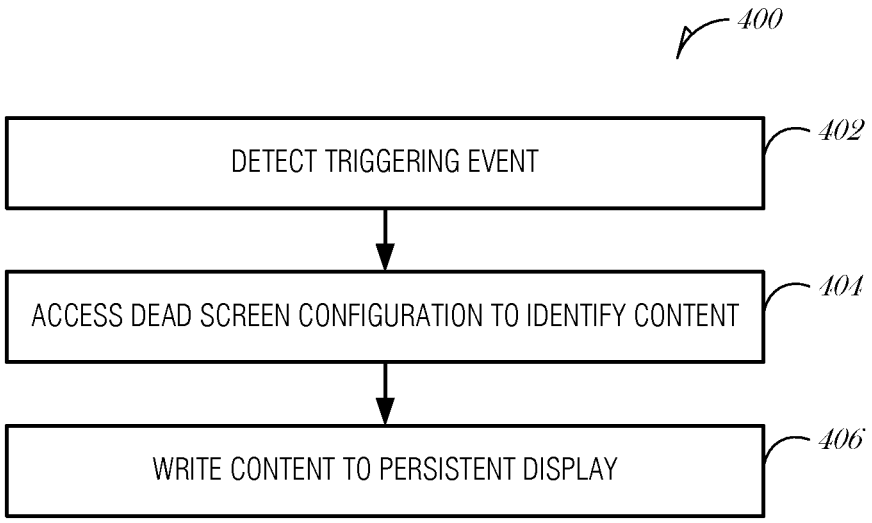
FIG. 4 is a flowchart illustrating a method for controlling an electronic display, according to an embodiment.

FIG. 4 is a flowchart illustrating a method 400 for controlling an electronic display, according to an embodiment. At block 402, a triggering event is detected.

At block 404, a dead screen configuration is accessed in response to the triggering event, the dead screen configuration specifying content to display on a persistent display of a computing device after the computing device is powered down. In an embodiment, the triggering event comprises a low battery condition of the computing device. In an embodiment, the triggering event comprises a shutdown command. In various embodiments, the content includes at least one of a calendar event, a navigation route, a contact, or lost phone information.

At block 406, the specified content is written to the persistent display as an image. In an embodiment, writing the specified content to the persistent display comprises conditionally performing dithering on the image depending on a gamma metric of the image. In an embodiment, the gamma metric is calculated by analyzing pixels in the image to calculate a ratio of dark pixels to light pixels, and wherein the dithering is performed when the gamma metric is less than a threshold value of the ratio. In an embodiment, the threshold value is two-hundred. In a further embodiment, the method 400 comprises selecting a gamma value based on the ratio of dark pixels to light pixels and applying the gamma value to the image.

In an embodiment, selecting the gamma value comprises setting the gamma value to 0.6 when the ratio of dark pixels to light pixels is less than or equal to 0.25. In an embodiment, selecting the gamma value comprises setting the gamma value to 0.7 when the ratio of dark pixels to light pixels is between 0.25 and 0.5. In an embodiment, selecting the gamma value comprises setting the gamma value to 1.2 when the ratio of dark pixels to light pixels is greater than or equal to 1.

In an embodiment, the method comprises prompting a user of the computing device for a selection of content to be displayed on the persistent display.

In a further embodiment, the method 400 includes receiving a policy definition from a user, the policy definition including the triggering event and a resulting action. In an embodiment, the resulting action configures the specified content. In an embodiment, the computing device comprises a primary display and the persistent display, and the triggering event of the policy definition includes a state of the primary display and a state of the persistent display.

Embodiments may be implemented in one or a combination of hardware, firmware, and software. Embodiments may also be implemented as instructions stored on a machine-readable storage device, which may be read and executed by at least one processor to perform the operations described herein. A machine-readable storage device may include any non-transitory mechanism for storing information in a form readable by a machine (e.g., a computer). For example, a machine-readable storage device may include read-only memory (ROM), random-access memory (RAM), magnetic disk storage media, optical storage media, flash-memory devices, and other storage devices and media.

Examples, as described herein, may include, or may operate on, logic or a number of components, modules, or mechanisms. Modules may be hardware, software, or firmware communicatively coupled to one or more processors in order to carry out the operations described herein. Modules may hardware modules, and as such modules may be considered tangible entities capable of performing specified operations and may be configured or arranged in a certain manner. In an example, circuits may be arranged (e.g., internally or with respect to external entities such as other circuits) in a specified manner as a module. In an example, the whole or part of one or more computer systems (e.g., a standalone, client or server computer system) or one or more hardware processors may be configured by firmware or software (e.g., instructions, an application portion, or an application) as a module that operates to perform specified operations. In an example, the software may reside on a machine-readable medium. In an example, the software, when executed by the underlying hardware of the module, causes the hardware to perform the specified operations. Accordingly, the term hardware module is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comprise a general-purpose hardware processor configured using software; the general-purpose hardware processor may be configured as respective different modules at different times. Software may accordingly configure a hardware processor, for example, to constitute a particular module at one instance of time and to constitute a different module at a different instance of time. Modules may also be software or firmware modules, which operate to perform the methodologies described herein.

Figure 5:
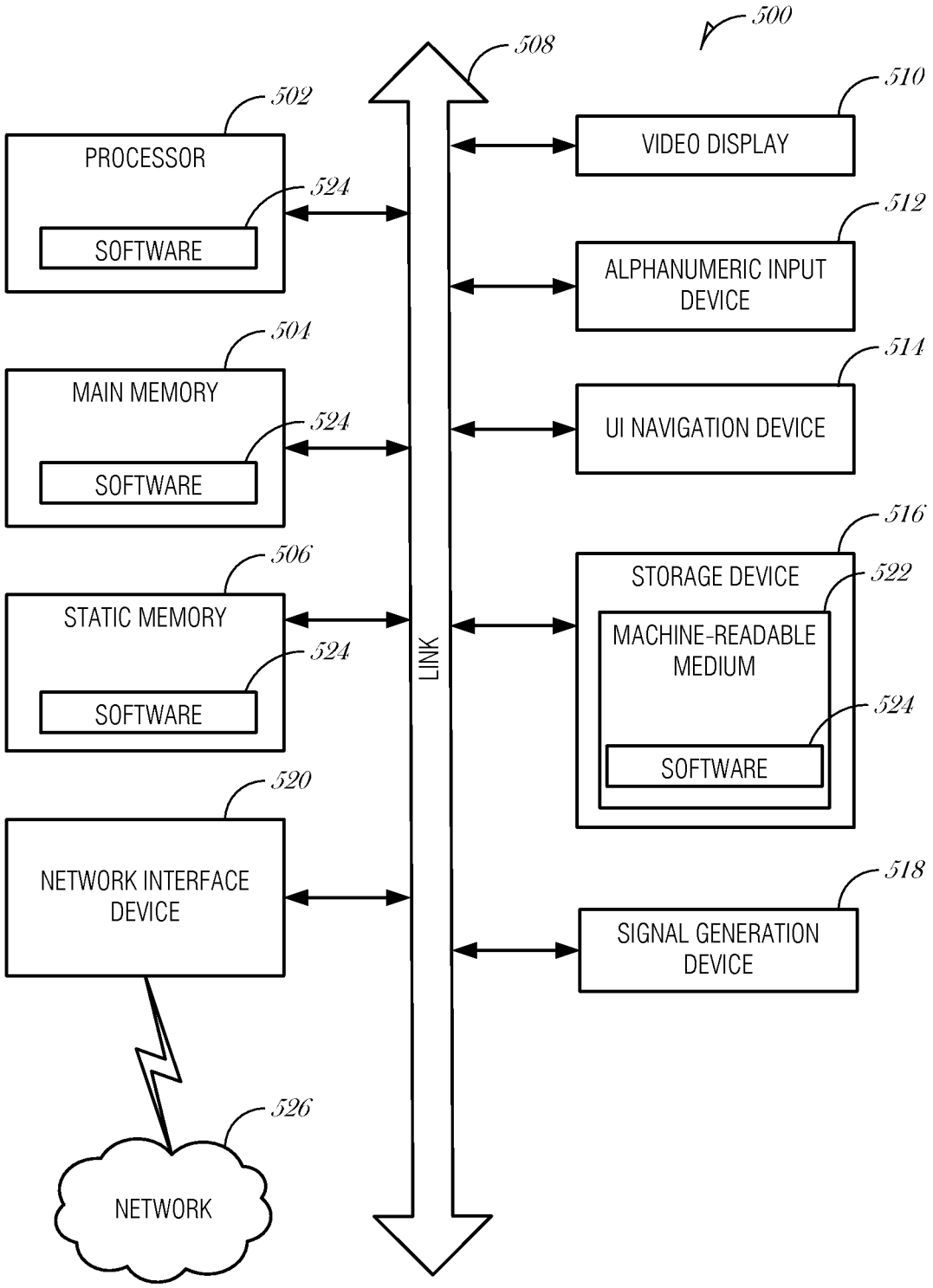
FIG. 5 is a block diagram illustrating an example machine upon which any one or more of the techniques (e.g., methodologies) discussed herein may perform, according to an example embodiment.

FIG. 5 is a block diagram illustrating a machine in the example form of a computer system 500, within which a set or sequence of instructions may be executed to cause the machine to perform any one of the methodologies discussed herein, according to an example embodiment. In alternative embodiments, the machine operates as a standalone device or may be connected (e.g., networked) to other machines. In a networked deployment, the machine may operate in the capacity of either a server or a client machine in server-client network environments, or it may act as a peer machine in peer-to-peer (or distributed) network environments. The machine may be an onboard vehicle system, wearable device, personal computer (PC), a tablet PC, a hybrid tablet, a personal digital assistant (PDA), a mobile telephone, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein. Similarly, the term "processor-based system" shall be taken to include any set of one or more machines that are controlled by or operated by a processor (e.g., a computer) to individually or jointly execute instructions to perform any one or more of the methodologies discussed herein.

Example computer system 500 includes at least one processor 502 (e.g., a central processing unit (CPU), a graphics processing unit (GPU) or both, processor cores, compute nodes, etc.), a main memory 504 and a static memory 506, which communicate with each other via a link 508 (e.g., bus). The computer system 500 may further include a video display unit 510, an alphanumeric input device 512 (e.g., a keyboard), and a user interface (UI) navigation device 514 (e.g., a mouse). In one embodiment, the video display unit 510, input device 512 and UI navigation device 514 are incorporated into a touch screen display. The computer system 500 may additionally include a storage device 516 (e.g., a drive unit), a signal generation device 518 (e.g., a speaker), a network interface device 520, and one or more sensors (not shown), such as a global positioning system (GPS) sensor, compass, accelerometer, or other sensor.

The storage device 516 includes a machine-readable medium 522 on which is stored one or more sets of data structures and instructions 524 (e.g., software) embodying or utilized by any one or more of the methodologies or functions described herein. The instructions 524 may also reside, completely or at least partially, within the main memory 504, static memory 506, and/or within the processor 502 during execution thereof by the computer system 500, with the main memory 504, static memory 506, and the processor 502 also constituting machine-readable media.

While the machine-readable medium 522 is illustrated in an example embodiment to be a single medium, the term "machine-readable medium" may include a single medium or multiple media (e.g., a centralized or distributed database, and/or associated caches and servers) that store the one or more instructions 524. The term "machine-readable medium" shall also be taken to include any tangible medium that is capable of storing, encoding or carrying instructions for execution by the machine and that cause the machine to perform any one or more of the methodologies of the present disclosure or that is capable of storing, encoding or carrying data structures utilized by or associated with such instructions. The term "machine-readable medium" shall accordingly be taken to include, but not be limited to, solid-state memories, and optical and magnetic media. Specific examples of machine-readable media include non-volatile memory, including but not limited to, by way of example, semiconductor memory devices (e.g., electrically programmable read-only memory (EPROM), electrically erasable programmable read-only memory (EEPROM)) and flash memory devices; magnetic disks such as internal hard disks and removable disks; magneto-optical disks; and CD-ROM and DVD-ROM disks.

The instructions 524 may further be transmitted or received over a communications network 526 using a transmission medium via the network interface device 520 utilizing any one of a number of well-known transfer protocols (e.g., HTTP). Examples of communication networks include a local area network (LAN), a wide area network (WAN), the Internet, mobile telephone networks, plain old telephone (POTS) networks, and wireless data networks (e.g., Wi-Fi, 3G, and 4G LTE/LTE-A or WiMAX networks). The term "transmission medium" shall be taken to include any intangible medium that is capable of storing, encoding, or carrying instructions for execution by the machine, and includes digital or analog communications signals or other intangible medium to facilitate communication of such software.

Additional Notes & Examples

Example 1 includes subject matter for presenting contents on a persistent display (such as a device, apparatus, or machine) comprising a system comprising: a persistent display; a trigger module to detect a triggering event; a configuration module to access a dead screen configuration in response to the triggering event, the dead screen configuration specifying content to display on the persistent display of the system after the system is powered down; and an output module to write the specified content to the persistent display as an image.

In Example 2, the subject matter of Example 1 may optionally include, wherein the triggering event comprises a low battery condition of the system.

In Example 3, the subject matter of any one or more of Examples 1 to 2 may optionally include, wherein the triggering event comprises a shutdown command.

In Example 4, the subject matter of any one or more of Examples 1 to 3 may optionally include, an interface module to prompt a user of the system for a selection of content to be displayed on the persistent display.

In Example 5, the subject matter of any one or more of Examples 1 to 4 may optionally include, wherein the content includes at least one of a calendar event, a navigation route, a contact, or lost phone information.

In Example 6, the subject matter of any one or more of Examples 1 to 5 may optionally include, wherein to write the specified content to the persistent display, the output module conditionally performs dithering on the image depending on a gamma metric of the image.

In Example 7, the subject matter of any one or more of Examples 1 to 6 may optionally include, wherein the gamma metric is calculated by analyzing pixels in the image to calculate a ratio of dark pixels to light pixels, and wherein the dithering is performed when the gamma metric is less than a threshold value of the ratio.

In Example 8, the subject matter of any one or more of Examples 1 to 7 may optionally include, wherein the threshold value is two-hundred.

In Example 9, the subject matter of any one or more of Examples 1 to 8 may optionally include, comprising a gamma module to: select a gamma value based on the ratio of dark pixels to light pixels; and apply the gamma value to the image.

In Example 10, the subject matter of any one or more of Examples 1 to 9 may optionally include, wherein to select the gamma value, the gamma module sets the gamma value to 0.6 when the ratio of dark pixels to light pixels is less than or equal to 0.25.

In Example 11, the subject matter of any one or more of Examples 1 to 10 may optionally include, wherein to select the gamma value, the gamma module sets the gamma value to 0.7 when the ratio of dark pixels to light pixels is between 0.25 and 0.5.

In Example 12, the subject matter of any one or more of Examples 1 to 11 may optionally include, wherein to select the gamma value, the gamma module sets the gamma value to 1.2 when the ratio of dark pixels to light pixels is greater than or equal to 1.

In Example 13, the subject matter of any one or more of Examples 1 to 12 may optionally include, a policy module to receive a policy definition from a user, the policy definition including the triggering event and a resulting action.

In Example 14, the subject matter of any one or more of Examples 1 to 13 may optionally include, wherein the resulting action configures the specified content.

In Example 15, the subject matter of any one or more of Examples 1 to 14 may optionally include, wherein the system comprises a primary display and the persistent display, and wherein the triggering event of the policy definition includes a state of the primary display and a state of the persistent display.

Example 16 includes subject matter for controlling an electronic display (such as a method, means for performing acts, machine readable medium including instructions that when performed by a machine cause the machine to performs acts, or an apparatus configured to perform) comprising: detecting a triggering event; accessing a dead screen configuration in response to the triggering event, the dead screen configuration specifying content to display on a persistent display of a computing device after the computing device is powered down; and writing the specified content to the persistent display as an image.

In Example 17, the subject matter of Example 16 may optionally include, wherein the triggering event comprises a low battery condition of the computing device.

In Example 18, the subject matter of any one or more of Examples 16 to 17 may optionally include, wherein the triggering event comprises a shutdown command.

In Example 19, the subject matter of any one or more of Examples 16 to 18 may optionally include, prompting a user of the computing device for a selection of content to be displayed on the persistent display.

In Example 20, the subject matter of any one or more of Examples 16 to 19 may optionally include, wherein the content includes at least one of a calendar event, a navigation route, a contact, or lost phone information.

In Example 21, the subject matter of any one or more of Examples 16 to 20 may optionally include, wherein writing the specified content to the persistent display comprises conditionally performing dithering on the image depending on a gamma metric of the image.

In Example 22, the subject matter of any one or more of Examples 16 to 21 may optionally include, wherein the gamma metric is calculated by analyzing pixels in the image to calculate a ratio of dark pixels to light pixels, and wherein the dithering is performed when the gamma metric is less than a threshold value of the ratio.

In Example 23, the subject matter of any one or more of Examples 16 to 22 may optionally include, wherein the threshold value is two-hundred.

In Example 24, the subject matter of any one or more of Examples 16 to 23 may optionally include, selecting a gamma value based on the ratio of dark pixels to light pixels; and applying the gamma value to the image.

In Example 25, the subject matter of any one or more of Examples 16 to 24 may optionally include, wherein selecting the gamma value comprises setting the gamma value to 0.6 when the ratio of dark pixels to light pixels is less than or equal to 0.25.

In Example 26, the subject matter of any one or more of Examples 16 to 25 may optionally include, wherein selecting the gamma value comprises setting the gamma value to 0.7 when the ratio of dark pixels to light pixels is between 0.25 and 0.5.

In Example 27, the subject matter of any one or more of Examples 16 to 26 may optionally include, wherein selecting the gamma value comprises setting the gamma value to 1.2 when the ratio of dark pixels to light pixels is greater than or equal to 1.

In Example 28, the subject matter of any one or more of Examples 16 to 27 may optionally include, receiving a policy definition from a user, the policy definition including the triggering event and a resulting action.

In Example 29, the subject matter of any one or more of Examples 16 to 28 may optionally include, wherein the resulting action configures the specified content.

In Example 30, the subject matter of any one or more of Examples 16 to 29 may optionally include, wherein the computing device comprises a primary display and the persistent display, and wherein the triggering event of the policy definition includes a state of the primary display and a state of the persistent display.

Example 31 includes a machine-readable medium including instructions for controlling an electronic display, which when executed by a machine, cause the machine to perform operations of any of the Examples 16-30.

Example 32 includes an apparatus comprising means for performing any of the methods of claims 16-30.

Example 33 includes an apparatus comprising: means for detecting a triggering event; means for accessing a dead screen configuration in response to the triggering event, the dead screen configuration specifying content to display on a persistent display of a computing device after the computing device is powered down; and means for writing the specified content to the persistent display as an image.

The above detailed description includes references to the accompanying drawings, which form a part of the detailed description. The drawings show, by way of illustration, specific embodiments that may be practiced. These embodiments are also referred to herein as "examples." Such examples may include elements in addition to those shown or described. However, also contemplated are examples that include the elements shown or described. Moreover, also contemplate are examples using any combination or permutation of those elements shown or described (or one or more aspects thereof), either with respect to a particular example (or one or more aspects thereof), or with respect to other examples (or one or more aspects thereof) shown or described herein.

Publications, patents, and patent documents referred to in this document are incorporated by reference herein in their entirety, as though individually incorporated by reference. In the event of inconsistent usages between this document and those documents so incorporated by reference, the usage in the incorporated reference(s) are supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to suggest a numerical order for their objects.

The above description is intended to be illustrative, and not restrictive. For example, the above-described examples (or one or more aspects thereof) may be used in combination with others. Other embodiments may be used, such as by one of ordinary skill in the art upon reviewing the above description. The Abstract is to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. However, the claims may not set forth every feature disclosed herein as embodiments may feature a subset of said features. Further, embodiments may include fewer features than those disclosed in a particular example. Thus, the following claims are hereby incorporated into the Detailed Description, with a claim standing on its own as a separate embodiment. The scope of the embodiments disclosed herein is to be determined with reference to the appended claims, along with the full scope of equivalents to which such claims are entitled.

What is claimed is:

1. A system for controlling an electronic display, the system comprising:

a persistent display;

a trigger circuit to detect a triggering event;

a configuration circuit to access a dead screen configuration in response to the triggering event, the dead screen configuration specifying content to display on the persistent display of the system after the system is powered down; and an output circuit to write the specified content to the persistent display as an image, and conditionally perform dithering on the image depending on a gamma metric of the image.

2. The system of claim 1, wherein the triggering event comprises a low battery condition of the system.

3. The system of claim 1, wherein the triggering event comprises a shutdown command.

4. The system of claim 1, comprising an interface circuit to prompt a user of the system for a selection of content to be displayed on the persistent display.

5. The system of claim 1, wherein the content includes at least one of a calendar event, a navigation route, a contact, or lost phone information.

6. The system of claim 1, wherein the gamma metric is calculated by analyzing pixels in the image to calculate a ratio of dark pixels to light pixels, and wherein the dithering is performed when the gamma metric is less than a threshold value of the ratio.

7. The system of claim 6, wherein the threshold value is two-hundred.

8. The system of claim 1, comprising a gamma circuit to:

select a gamma value based on the ratio of dark pixels to light pixels; and apply the gamma value to the image.

9. The system of claim 8, wherein to select the gamma value, the gamma circuit sets the gamma value to 0.6 when the ratio of dark pixels to light pixels is less than or equal to 0.25.

10. The system of claim 8, wherein to select the gamma value, the gamma circuit sets the gamma value to 0.7 when the ratio of dark pixels to light pixels is between 0.25 and 0.5.

11. The system of claim 8, wherein to select the gamma value, the gamma circuit sets the gamma value to 1.2 when the ratio of dark pixels to light pixels is greater than or equal to 1.

12. The system of claim 1, comprising a policy circuit to receive a policy definition from a user, the policy definition including the triggering event and a resulting action.

13. The system of claim 12, wherein the resulting action configures the specified content.

14. The system of claim 12, wherein the system comprises a primary display and the persistent display, and wherein the triggering event of the policy definition includes a state of the primary display and a state of the persistent display.

15. A method of controlling an electronic display, the method comprising:

detecting a triggering event;

accessing a dead screen configuration in response to the triggering event, the dead screen configuration specifying content to display on a persistent display of a computing device after the computing device is powered down; and writing the specified content to the persistent display as an image, including conditionally performing dithering on the image depending on a gamma metric of the image.

16. The method of claim 15, wherein the triggering event comprises a low battery condition of the computing device.

17. The method of claim 15, wherein the triggering event comprises a shutdown command.

18. The method of claim 15, comprising prompting a user of the computing device for a selection of content to be displayed on the persistent display.

19. A non-transitory machine-readable medium including instructions for controlling an electronic display, which when executed by a machine, cause the machine to:

detect a triggering event;

access a dead screen configuration in response to the triggering event, the dead screen configuration specifying content to display on a persistent display of a computing device after the computing device is powered down; and write the specified content to the persistent display as an image, including conditionally performing dithering on the image depending on a gamma metric of the image.

20. The non-transitory machine-readable medium of claim 19, wherein the gamma metric is calculated by analyzing pixels in the image to calculate a ratio of dark pixels to light pixels, and wherein the dithering is performed when the gamma metric is less than a threshold value of the ratio.

21. The non-transitory machine-readable medium of claim 20, wherein the threshold value is two-hundred.

22. The non-transitory machine-readable medium of claim 19, comprising instructions to: select a gamma value based on the ratio of dark pixels to light pixels; and apply the gamma value to the image.

23. The non-transitory machine-readable medium of claim 19, comprising instructions to receive a policy definition from a user, the policy definition including the triggering event and a resulting action.

24. The method of claim 15, wherein the gamma metric is calculated by analyzing pixels in the image to calculate a ratio of dark pixels to light pixels, and wherein the dithering is performed when the gamma metric is less than a threshold value of the ratio.

25. The method of claim 15, comprising:

selecting a gamma value based on the ratio of dark pixels to light pixels; and applying the gamma value to the image.

* * * * *